US008327671B2

(12) United States Patent
Kim

(10) Patent No.: US 8,327,671 B2
(45) Date of Patent: Dec. 11, 2012

(54) WASHING MACHINE

(75) Inventor: Tae Woo Kim, Yangsan-si (KR)

(73) Assignee: LG Electronics Inc., Seoul (KR)

( * ) Notice: Subject to any disclaimer, the term of this patent is extended or adjusted under 35 U.S.C. 154(b) by 819 days.

(21) Appl. No.: 12/089,842

(22) PCT Filed: Oct. 13, 2006

(86) PCT No.: PCT/KR2006/004141

§ 371 (c)(1),
(2), (4) Date: Nov. 12, 2008

(87) PCT Pub. No.: WO2007/043838

PCT Pub. Date: Apr. 19, 2007

(65) Prior Publication Data

US 2009/0217712 A1 Sep. 3, 2009

(30) Foreign Application Priority Data

Oct. 13, 2005 (KR) ..... 10-2005-0096485

(51) Int. Cl.
*D06F 33/02* (2006.01)
*D06F 39/00* (2006.01)

(52) U.S. Cl. ..... 68/12.27

(58) Field of Classification Search ..... 68/3 R, 68/12.23, 12.27; 200/11 R, 564, 296, 336
See application file for complete search history.

(56) References Cited

U.S. PATENT DOCUMENTS 5,464,955 A * 11/1995 Cole ..... 200/317
6,507,967 B2 * 1/2003 Johnson ..... 8/159
6,750,407 B2 * 6/2004 Song et al. ..... 200/5 A
(Continued)

FOREIGN PATENT DOCUMENTS

JP 7-282969 10/1995
(Continued)

OTHER PUBLICATIONS

German Office Action dated Dec. 6, 2010 issued in Application No. 11 2006 002 707.7.

*Primary Examiner* — Joseph L Perrin
(74) *Attorney, Agent, or Firm* — KED & Associates, LLP

(57) ABSTRACT

A washing machine having a structure in which operating conditions of the washing machine are inputted by a rotary knob (7), and current operating conditions are displayed by the light emitted from an LED and transmitted through a display unit (130) is disclosed. The interference of the light emitted from the LED is interrupted, whereby the operating conditions of the washing machine are clearly displayed. The washing machine includes a control panel (30) mounted at the front part of a machine body of the washing machine, a rotary knob (7) mounted at the control panel (30) for allowing a user to input operating conditions of the washing machine in a rotating fashion, a display unit (130) mounted around the rotary knob (7) for displaying the operating conditions of the washing machine inputted by the rotary knob (7), a controller coupled to the inside of the control panel (30), the controller having a plurality of partitioned LEDs that can be selectively turned on according to the input from the rotary knob (7), and a decoration panel (140) disposed between the display unit (30) and an LED supporter, which supports the LEDs, for allowing light emitted from the selected LED to be transmitted through the display unit (130) without leakage.

20 Claims, 5 Drawing Sheets

U.S. PATENT DOCUMENTS

| | | | | |
|---|---|---|---|---|
| 6,813,524 | B2 * | 11/2004 | Peterson et al. | 700/13 |
| 6,813,911 | B2 * | 11/2004 | Peterson et al. | 68/12.27 |
| 6,856,841 | B2 * | 2/2005 | Peterson | 700/19 |
| 6,862,482 | B2 * | 3/2005 | Peterson et al. | 700/19 |
| 7,000,436 | B2 * | 2/2006 | Peterson | 68/12.04 |
| 7,038,156 | B2 * | 5/2006 | Kim et al. | 200/564 |
| 7,180,023 | B2 * | 2/2007 | Seo | 200/329 |
| 2002/0138918 | A1 * | 10/2002 | Johnson | 8/159 |
| 2003/0024796 | A1 | 2/2003 | Peterson et al. | |
| 2004/0148972 | A1 | 8/2004 | Kang | |
| 2005/0183471 | A1 | 8/2005 | Kang et al. | 68/12.27 |

FOREIGN PATENT DOCUMENTS

| | | | |
|---|---|---|---|
| KR | 10-2004-0046987 | | 6/2004 |
| KR | 10-2004-0069136 | | 8/2004 |
| KR | 1020060103578 | A * | 10/2006 |

* cited by examiner

WASHING MACHINE

TECHNICAL FIELD

The present invention relates to a washing machine, and more particularly, to a washing machine having a structure in which operating conditions of the washing machine are inputted by a rotary knob, and current operating conditions are displayed by the light emitted from an LED and transmitted through a display unit, wherein the interference of the light emitted from the LED is interrupted, whereby the operating conditions of the washing machine are clearly displayed.

BACKGROUND ART

Generally, a drum-type washing machine is a kind of washing machine that performs a washing operation using impact applied to laundry, which is put in a drum, dropping as the drum is rotated by a driving force of a motor under the condition that detergent and wash water are also put in the drum. The drum-type washing machine has various effects in that the laundry is struck and rubbed, there is little friction between the laundry and the drum, which minimizes damage to the laundry, and the laundry is not entangled.

Also, the drum-type washing machine has an advantage in that the consumption of wash water is considerably decreased as compared with a general pulsator-type washing machine. As a result, the demand of the drum-type washing machine has gradually increased as compared with the pulsator-type washing machine.

FIG. 1 is a perspective view illustrating the appearance of a conventional drum-type washing machine. The appearance of the drum-type washing machine is defined by a machine body 1 formed in the shape of a rectangular parallelepiped. Inside the drum-type washing machine is mounted a drum (not shown) in which laundry to be washed is put.

At the front part of the machine body 1 of the drum-type washing machine is mounted a door 2, by which the interior and the exterior of the washing machine selectively communicate with each other such that laundry is put into the drum or the laundry is removed from the drum out of the machine body 1.

At the upper side of the front part of the machine body 1 of the drum-type washing machine is mounted a control panel 3 including input buttons for allowing a user to input various operating conditions, such as washing courses and rinsing and spin-drying modes, and a display unit for displaying the remaining time.

At one side of the control panel is generally mounted a detergent box 4, in which detergent is stored.

FIG. 2 is a front view illustrating the control panel of the conventional drum-type washing machine. As shown in FIG. 2, the control panel 3 includes a plurality of buttons 8, a display window 5, a light emitting diode (LED) window 6 and a rotary knob 7.

The respective buttons 4 and the rotary knob 7 are input units for operating the washing machine. When a washing time, a washing course, and spin-drying and drying modes, are to be selected, a user manipulates the input units to input a desired washing course and a desired washing time.

The LED window 6 and the display window 5 serve to inform the user of various kinds of washing information, such as the washing progress and the remaining time. Specifically, the LED window 6 blinks to inform the user of the corresponding information, whereas the display window 5 displays characters or symbols to inform the user of the corresponding information.

The transmission of the information through the LED window is accomplished by a combination of blinking LEDs and the characters or the symbols printed at the front surface of the control panel corresponding to the blinking LEDs.

Inside the control panel 3 is mounted a controller, which functions as a control unit. FIG. 3 is an exploded perspective view illustrating the control panel 3 and the controller 10.

As shown in FIG. 3, the controller 10 includes pluralities of chips and circuit parts, a rotary knob, and a display unit 30. When the controller 10 is coupled with the control panel 3, the display unit 30 is first coupled to the control panel 3 through an insertion hole 9 formed in the control panel 3, and then the rotary knob 7 is inserted through the display unit 30. As a result, the rotary knob 7 is disposed at the front of the control panel 3.

The rotary knob 7 is a part frequently manipulated by a user. The rotary knob 7 is used to set the washing course or the washing time. Around the rotary knob 7 is mounted a lighting unit, such as LEDs, for clearly informing the user of the washing course or the washing time selected by the used.

Specifically, a plurality of LEDs 27 (see FIG. 4), which are selectively turned on according to the input of the rotary knob 7, and an LED supporter 25 for supporting the LEDs are mounted at a predetermined position of the controller 10 corresponding to the display unit 30.

Through the lighting unit, the user can clearly confirm the input state even in a dark room or in the night as well as in the daytime.

FIG. 4 is a sectional view illustrating the structure of the display unit of the conventional drum-type washing machine. As shown in FIG. 4, a rotary switch, which includes an encoder 20 and an encoder shaft 21 connected to the encoder 20, is mounted on the controller 10. The rotary knob 7, which is held and manipulated by a user, is coupled to the encoder shaft 21 of the rotary switch. Specifically, the user manipulates the rotary knob 7 mounted at the control panel 3 such that the user can input the operating conditions using the encoder 20 mounted at the controller 10 through the encoder shaft 21.

The rotary switch changes the number of pulses depending upon the right and left rotation amount of the rotary knob 7 coupled to the encoder shaft 21. The changed number of pulses is transmitted to a microprocessor (not shown) through the controller 10, whereby the washing machine is operated according to the corresponding operating conditions.

The LED supporter 25 is mounted on the controller 10 at the outside of the rotary knob 7 such that the LED supporter 25 surrounds the rotary knob 7.

At this time, the LED supporter 25 is constructed in a structure in which a plurality of LED location holes 26 are disposed along the circumferential direction in the shape of a ring, and the plurality of LEDs 27 are disposed in the LED location holes 26, respectively, as shown in FIGS. 3 and 4. Consequently, the LED location holes 26 serve as partitions to prevent interference between the blinking LED and the neighboring LEDs.

As shown in FIGS. 3 and 4, the display unit of the conventional drum-type washing machine is formed in the shape of a ring, and is disposed between the control panel 3 and the rotary knob 7. The display unit 30 is coupled with the inside part of the insertion hole 9 formed in the control panel 3 such that the rotary knob 7 can be inserted through the insertion hole 9.

In other words, hooks 33 formed at the inner surface of the control panel are inserted into grooves 32 formed at the edge of the display unit 30, respectively. After the display unit 30 is coupled to the control panel 3, the control panel 3 is coupled with the controller 10. Here, the coupling between the control panel 3 and the display unit 30 is accomplished by positioning the display unit 30 at the inside of the control panel 3 such that the hooks are aligned with the grooves, respectively, and pushing the display unit 30 toward the outside of the control panel 3.

Consequently, the rotary knob is inserted into the inside of the display unit, and therefore, the rotary knob is located at the front of the control panel.

Hereinafter, the principle of informing the user of the operating information through the display unit and the LEDs will be described.

The plurality of LEDs 27 are arranged around the rotary knob 7. As the rotary knob is rotated, the corresponding LED is turned on. The light generated from the turned-on LED is not scattered but is gathered through the corresponding LED location hole 26 of the LED supporter 25. In this connection, the display unit may be provided at predetermined positions thereof corresponding to the LED location holes 26 with display holes 31, through which light generated from the LEDs is gathered and emitted, or a predetermined semitransparent film.

In the case of forming the semitransparent film, the respective operating conditions are printed on the semitransparent film, and therefore, it is possible to clearly display the current operating conditions when the light generated from the LEDs is emitted. In the case of forming the display holes, the operating conditions are displayed at a predetermined position of the control panel corresponding to the display holes through which the light generated from the LEDs is emitted, thereby clearly displaying the current operating conditions.

Recently, on the other hand, there has been provided a drum-type washing machine constructed in a structure in which the temperature of wash water is increased to the temperature level set by a user, and the wash water having the increased temperature is supplied into the drum to perform a washing operation, thereby accomplishing more effective washing. For example, this kind of drum-type washing machine has a boiling function to increase the temperature of the wash water to approximately a boiling point and then perform a washing operation.

In this kind of drum-type washing machine, therefore, the selection of the washing course and the input of the temperature of the wash water are performed by the rotary knob. This kind of control panel 3 is shown in FIG. 2.

The display unit 30 is disposed around the rotary knob 7, and the display unit 30 is divided into a plurality of wash water temperature display parts 34 in the circumferential direction such that the temperatures of the wash water are displayed on the respective wash water temperature display parts 34. At the front surface of the control panel surrounding the display unit 30 are disposed washing course display parts 35, on which washing courses are displayed corresponding to the divided wash water temperature display parts 34.

FIG. 2 illustrates, for example, seven divided washing course display parts 35. According to the respective washing courses, at least one temperature of the wash water is displayed on the display unit 30.

As shown in FIG. 2, the user can input one of the washing courses displayed on the control panel by rotating the rotary knob. In the respective washing courses, the rotation angle of the rotary knob is divided, whereby it is possible for the user to input the temperature of the wash water displayed on the display unit according to the rotation angle.

Specifically, it is possible for user to input composite operating conditions, such as the washing courses displayed on the control panel and the temperature of the wash water displayed on the display unit, using a single rotary knob. In other words, when the user rotates the rotary knob to a specific position, the washing courses and the temperature of the wash water, i.e., the composite operating conditions of the washing machine, are inputted correspondingly.

On the other hand, the composite operating conditions of the washing machine may include the water level of the wash water, the washing time, or the RPM of the drum at the time of the spin-drying operation.

In other words, it is possible to input the composite operating conditions, including the washing courses, the temperature of the wash water, the RPM of the drum at the time of the spin-drying operation, using a single rotary knob.

In the conventional drum-type washing machine illustrated in FIGS. 1 to 4, however, the display unit for displaying the operating conditions of the washing machine inputted by the rotary knob is directly coupled to the control panel with the result that it is difficult to adjust the gap d between the display unit and the LED supporter.

Specifically, the gap d is formed between the display unit and the LED supporter as shown in FIG. 4, and therefore, the light emitted from the corresponding LED leaks through the gap d. As a result, the intensity of the light is decreased, or it is difficult to confirm which condition the light emitted from the corresponding LED indicates.

When the diameter of the display unit is increased, the light may leak in the circumferential direction as well as in the radial direction. In this case, the above-mentioned problems become more serious.

In order to solve the problems, it may be possible to interrupt the light interference by transmitting the light through a specific region of the display unit and preventing the light from being transmitted through other regions of the display unit. In this case, however, the costs for manufacturing the display unit are greatly increased.

SUMMARY

An object of the present invention devised to solve the problem lies on a washing machine including a decoration panel disposed between a display unit and an LED supporter for interrupting the light interference, thereby clearly displaying the operating conditions of the washing machine.

The object of the present invention can be achieved by providing a washing machine comprising: a control panel mounted at the front part of a machine body of the washing machine; a rotary knob mounted at the control panel for allowing a user to input operating conditions of the washing machine in a rotating fashion; a display unit mounted around the rotary knob for displaying the operating conditions of the washing machine inputted by the rotary knob; a controller coupled to the inside of the control panel, the controller having a plurality of partitioned LEDs that can be selectively turned on according to the input from the rotary knob; and a decoration panel disposed between the display unit and an LED supporter, which supports the LEDs, for allowing light emitted from the selected LED to be transmitted through the display unit without leakage.

Preferably, the display unit is detachably coupled to the decoration panel.

The display unit may be coupled to the decoration panel by forcible fitting.

Specifically, the display unit may be provided with at least one hook or groove, and the decoration panel may be provided with at least one groove or hook corresponding to the at least one hook or groove of the display unit, the display unit being coupled to the decoration panel by engagement of the at least one hook into the at least one groove.

The decoration panel may include a receiving part for receiving the display unit, the receiving part being provided with a plurality of holes, through which the light emitted from the selected LED is transmitted.

The decoration panel includes an inner decoration panel disposed between the rotary knob and the display unit, and an outer decoration panel disposed between the display unit and the control panel, the inner decoration panel and the outer decoration panel being coupled to the control panel such that the inner decoration panel and the outer decoration panel are exposed at the front of the control panel.

Preferably, the inner decoration panel and the outer decoration panel are integrally formed with each other.

The display unit includes an inner circumferential display unit disposed to surround the rotary knob, and an outer circumferential display unit disposed to surround the inner circumferential display unit.

The receiving part includes an inner circumferential receiving part, corresponding to the inner circumferential display unit, disposed to surround the rotary knob, and an outer circumferential receiving part, corresponding to the outer circumferential display unit, disposed to surround the inner circumferential display unit.

The decoration panel may be detachably coupled to the control panel.

Specifically, the decoration panel may be provided with at least one groove, and the control panel may be provided with at least one hook corresponding to the at least one groove of the decoration panel, the decoration panel being coupled to the control panel by engagement of the at least one hook of the control panel into the at least one groove of the decoration panel.

Alternatively, the decoration panel may be provided with at least one hook, and the control panel may be provided with at least one groove corresponding to the at least one hook of the decoration panel, the decoration panel being coupled to the control panel by engagement of the at least one hook of the decoration panel into the at least one groove of the control panel.

The decoration panel may further include a plurality of ribs formed between the respective holes of the receiving part in the radial direction for interrupting the light interference in the circumferential direction.

Preferably, the display unit is coupled to the decoration panel in such a manner that the display unit is brought into tight contact with the ribs.

The inner circumferential receiving part of the receiving part may be provided with a plurality of holes, through which the light emitted from the selected LED is transmitted.

The receiving part may further include a step part formed between the inner circumferential receiving part and the outer circumferential receiving part for interrupting the light interference in the radial direction.

In another aspect of the present invention, provided herein is a washing machine comprising: a control panel mounted at the front part of a machine body of the washing machine; a rotary knob mounted at the control panel for allowing a user to input operating conditions of the washing machine in a rotating fashion; a controller coupled to the inside of the control panel for controlling the operation of the washing machine, the controller having a plurality of partitioned LEDs that can be selectively turned on according to the input from the rotary knob; and a light spread preventing unit mounted at the control panel for allowing light emitted from the plurality of LEDs to be transmitted to the front of the control panel through corresponding partitioned sections.

According to the present invention, the light emitted from the LED is directly transmitted through the display unit without leakage. Consequently, the present invention provides the effect of more clearly confirming the operating state of the washing machine.

Also, the display unit, on which the operating conditions of the washing machine inputted by the rotary knob are displayed, is more securely coupled to the control panel.

In addition, it is possible to easily couple the display unit to the control panel and to easily separate the display unit from the control panel for maintenance. Consequently, the manufacturing costs and the maintenance costs are reduced.

Furthermore, it is possible to provide the washing machine with a more pleasing appearance and to reduce the gap between the control panel and the display unit by placing the inner decoration panel and the outer decoration panel between the display unit and the control panel. Consequently, the present invention provides the effect of solving problems which may be caused due to the gap.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

DETAILED DESCRIPTION

Figure 1:
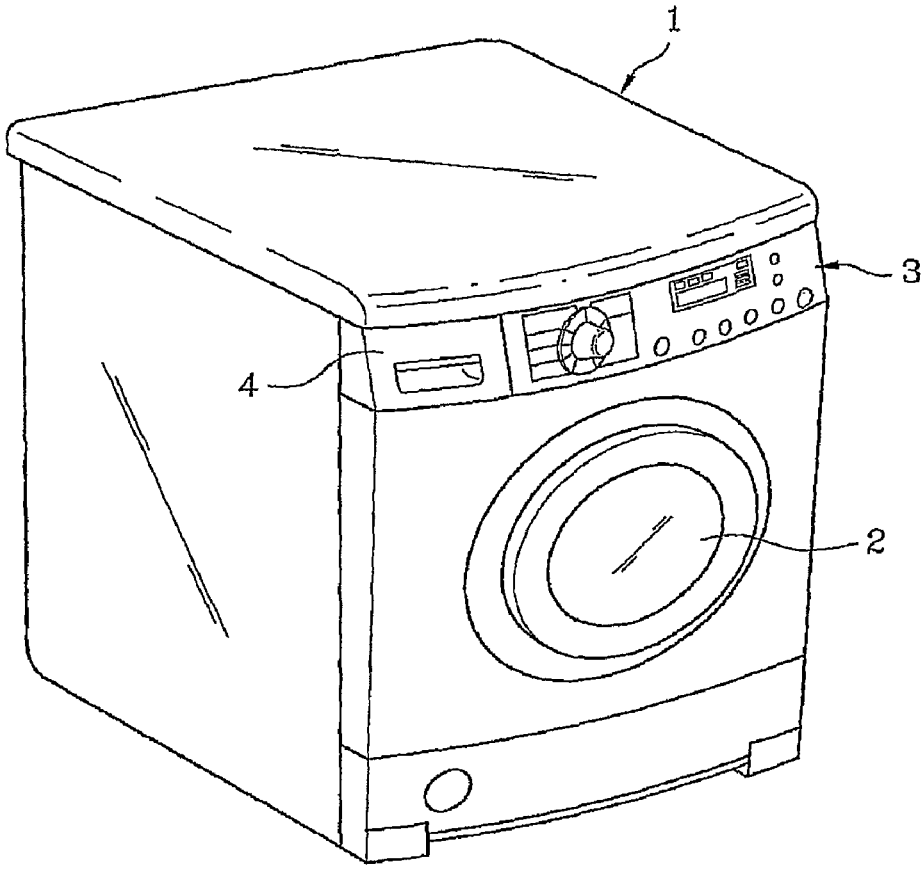
Fig. 1 PRIOR ART
FIG. 1 is a perspective view illustrating the appearance of a conventional drum-type washing machine.
Figure 2:
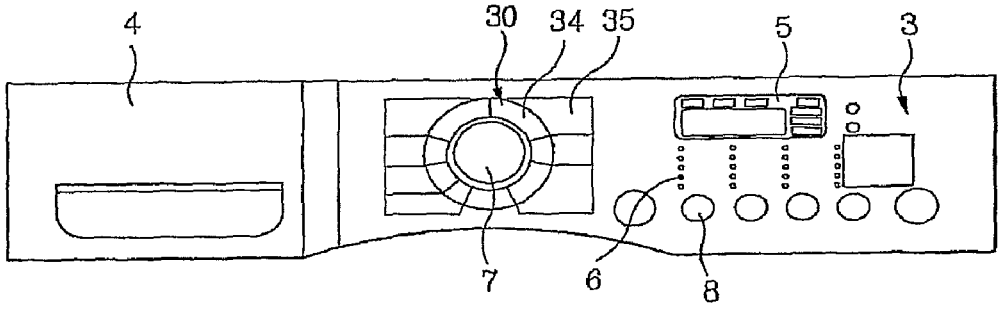
Fig. 2 PRIOR ART
FIG. 2 is a front view illustrating a control panel of the conventional drum-type washing machine.
Figure 3:
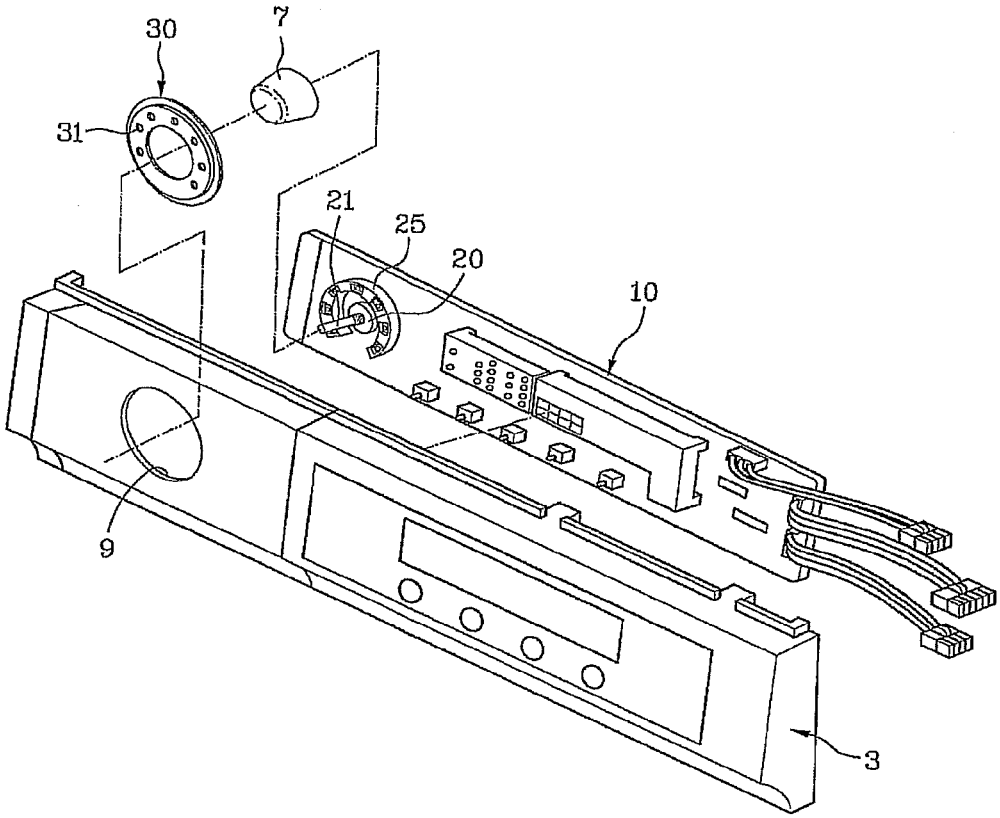
Fig. 3 PRIOR ART
FIG. 3 is an exploded perspective view illustrating the control panel and a controller of the conventional drum-type washing machine.

Reference will now be made in detail to the preferred embodiments of the present invention, examples of which are illustrated in the accompanying drawings.

Hereinafter, the present invention will be described in detail with reference to FIGS. 5 and 8.

In the following description of the present invention, the same titles and the same reference numerals will be accorded to components of the present invention corresponding to those of the conventional art in order to avoid the repetition of the description.

The washing machine according to the present invention includes a rotary knob, a display unit, a control panel, a controller having a lamp and a lamp supporter, and a light spread preventing unit mounted at the control panel for allowing light emitted from a plurality of LEDs to be transmitted to the front of the control panel through corresponding partitioned sections.

Hereinafter, a decoration panel will be illustrated and described as an example of the light spread preventing unit. The rotary knob, the control panel, and the controller were previously described in the background art, and therefore, a further detailed description thereof will not be given.

First, the display unit of the washing machine according to the present invention will be described with reference to FIG. 5.

Figure 5:
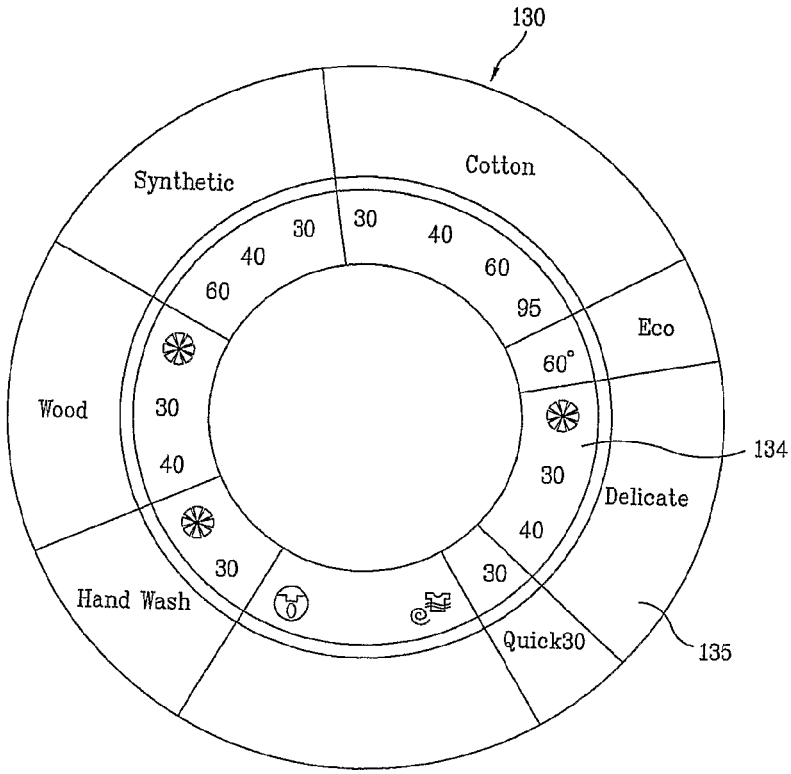
FIG. 5 is a front view illustrating a display unit of a washing machine according to the present invention.

FIG. 5 is a front view illustrating the display unit of the washing machine according to the present invention. Hereinafter, the display unit, on which the composite operating conditions of the washing machine inputted by the rotary knob, will be described in detail.

As will be described below, however, the characteristics of the present invention, i.e., the decoration panel according to the present invention and the coupling between the display unit and the control panel via the decoration panel, may be properly applied to the conventional display part, on which only one type of operating condition of the washing machine is displayed.

As shown in FIG. 5, it is preferable that the display unit of the washing machine according to the present invention be formed in the shape of a ring.

Of course, the display unit is not limited to the ring shape. The display unit may be formed in any shape so long as the rotary knob can be inserted through the central part of the display unit.

Unlike the conventional display unit, the display unit 130 according to the present invention includes an inner circumferential display unit 134 and an outer circumferential display unit 135. The inner circumferential display unit 134 may display temperature conditions of the wash water, whereas the outer circumferential display unit 135 may display washing courses.

Specifically, in a washing machine constructed in a structure in which, when a specific washing course is selected, the temperature condition of the wash water can be individually selected, it is possible to display the current washing course and the temperature condition of the wash water through a single display part 130.

As shown in FIG. 5, for example, seven washing courses are separately displayed on the outer circumferential display unit 135 of the display unit 130, and therefore, a user can select one of the seven washing courses. When the user wishes to select a cotton washing course, he/she can select one of the temperatures of the wash water displayed on the inner circumferential display unit 134, i.e., 30 degrees, 40 degrees, 60 degrees and 95 degrees. Of course, when the user wishes to select another washing course, he/she can select the corresponding washing temperature.

As shown in FIG. 5, it is possible to input two types of operating conditions, such as one type of operating condition, i.e., the washing course, and another type of operating condition, i.e., the temperature of the wash water. In other words, it is possible to display the composite operating conditions on a single display unit and to input the composite operating conditions of the washing machine by the rotating the rotary knob.

As previously described, however, the composite operating conditions of the washing machine are not limited to the above-specified ones. In other words, the composite operating conditions of the washing machine may include the washing course and the water level of the wash water. Alternatively, the composite operating conditions of the washing machine may include the washing course and the RPM of the drum at the time of the spin-drying (i.e., the intensity of the spin-drying).

In addition, the composite operating conditions of the washing machine may include three operating conditions. Specifically, it is possible to select the washing course, the temperature of the wash water corresponding to the selected washing, and the corresponding water level of the wash water.

While the composite operating conditions of the washing machine are displayed using a single display unit 130 as described above, the display unit of the washing machine according to the present invention may include an inner circumferential display unit mounted around the rotary knob for displaying one type of operating condition of the washing machine and an outer circumferential display unit disposed between the inner circumferential display unit and the control panel for displaying another type of operating condition of the washing machine.

In the case of a single display unit, for example, the inner circumferential display unit 134 and the outer circumferential display unit 135 may be individually formed. In this case, the inner circumferential display unit may display the temperature of the wash water, and the outer circumferential display unit may display the washing course, in the same manner.

When a plurality of display units are provided instead of a single display unit, the coupling of the display units may be complicated. In the case that the number of combinations of the composite operating conditions of the washing machine is large, however, the inner circumferential display unit and the outer circumferential display unit may be separately manufactured and then coupled with each other. Consequently, it is possible to change any one of the inner and outer circumferential display units, not the entirety of the display unit.

Hereinafter, the construction of the decoration panel of the washing machine according to the present invention and the coupling between the decoration panel and the display unit will be described in detail with reference to FIGS. 6 to 8.

Figure 6:
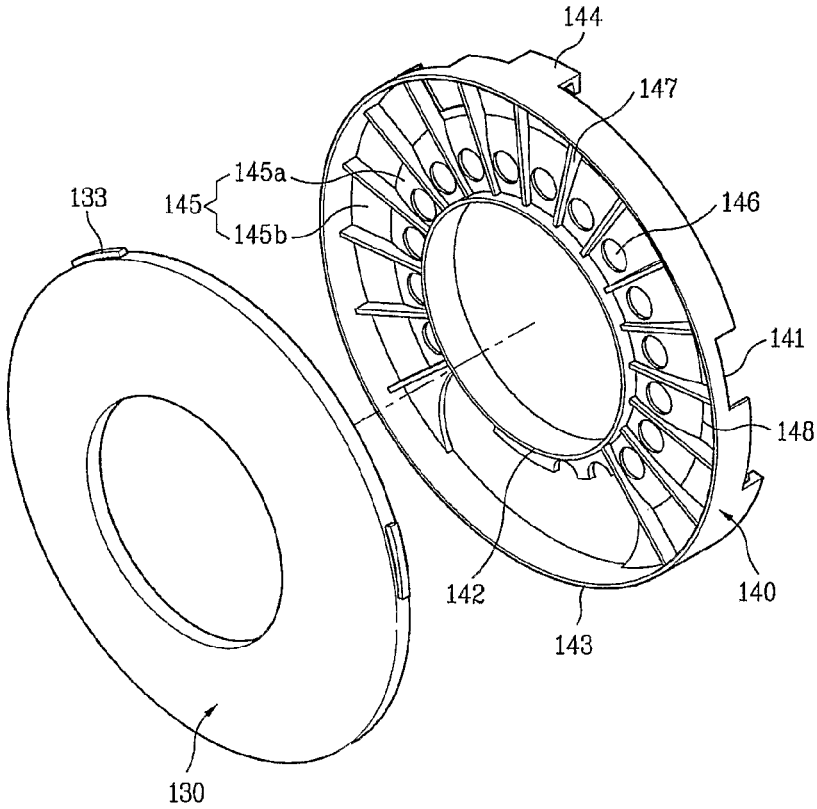
FIG. 6 is an exploded perspective view illustrating the display unit and a decoration panel of the washing machine according to the present invention.
Figure 7:
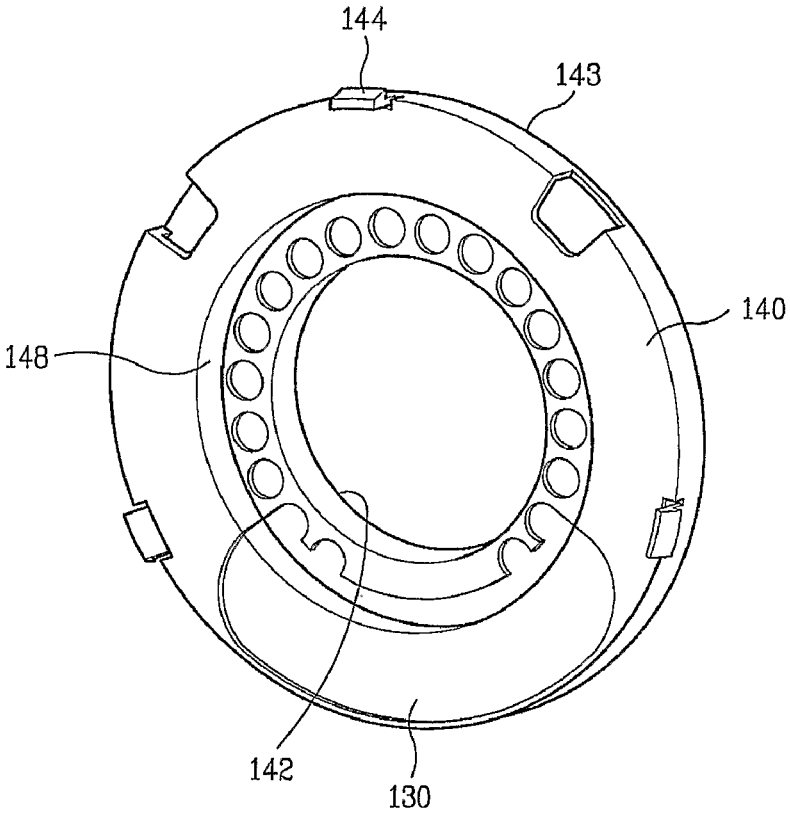
FIG. 7 is a rear perspective view illustrating the coupling between the display unit and the decoration panel of the washing machine according to the present invention.
Figure 8:
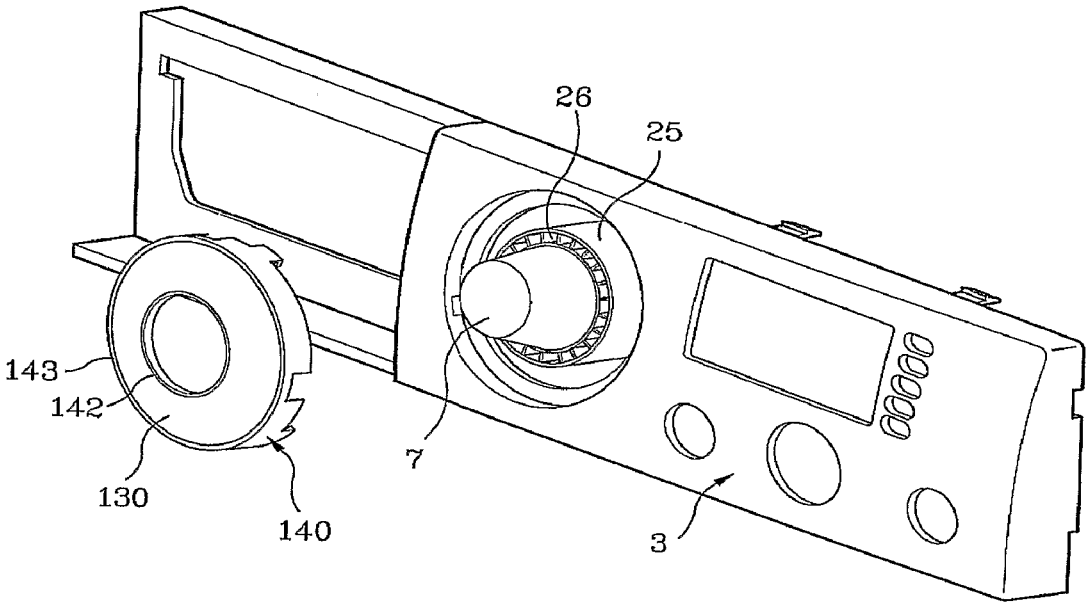
FIG. 8 is an exploded perspective view illustrating the display unit and a control panel of the washing machine according to the present invention.

FIG. 6 is an exploded perspective view illustrating the display unit and the decoration panel, FIG. 7 is a rear perspective view illustrating the coupling between the display unit and the decoration panel, and FIG. 8 is an exploded perspective view illustrating the display unit, the decoration panel, and the control panel.

Although the decoration panel and the display unit may be integrally manufactured, it is preferable that the display unit 130 be detachably coupled to the decoration panel 140 as shown in the drawings.

Specifically, it is preferable to differently manufacture the display unit rather than separately manufacture the control panel as previously described when manufacturing washing machines having various specifications. In this case, it is possible to easily replace the display unit.

The coupling between the display unit and the decoration panel may be accomplished by forming the outer diameter tolerance of the display unit and the inner diameter tolerance of the decoration panel, on which the display unit is fitted, and forcibly fitting the display unit onto the decoration panel.

Alternatively, the coupling between the display unit and the decoration panel may be accomplished by the engagement of hooks into grooves, into which the hooks are inserted. Specifically, at least one hook 133 may be formed at the display unit 130, at least one groove 141 corresponding to the at least one hook 133 may be formed at the decoration panel 140, and the at least one hook 133 may be engaged into the at least one groove 141, whereby the display unit and the decoration panel are detachably coupled with each other.

Conversely, one or more grooves may be formed at the display unit, and one or more hooks may be formed at the decoration panel.

Here, it is required that the coupling position of the display unit 130, the decoration panel 140, and a lamp supporter, which will be described below, be uniform. This is because the lamp which is turned on to display the current operating condition properly corresponds to a predetermined position of the display unit, through which light emitted from the lamp is transmitted.

Consequently, it is preferable to form one or more hooks or grooves such that the display unit can be coupled to the decoration panel only at a specific rotation angle so as to couple the display unit, the decoration panel, and the lamp supporter with each other in position. In the same manner, it is preferable to form one or more hooks or grooves such that the decoration panel can be coupled to the lamp supporter only at a specific rotation angle.

For example, when three hooks are formed at the display unit such that the angles between the respective hooks are 150 degrees, 150 degrees, and 60 degrees, and the grooves corresponding to the hooks are formed at the decoration panel, the display unit and the decoration panel are coupled with each other only at the correct rotation angle.

Meanwhile, the decoration panel 140 includes an inner decoration panel 142 disposed between the rotary knob 7 and the display unit 130 and an outer decoration panel 143 disposed between the display unit 130 and the control panel 3. Preferably, the inner decoration panel and the outer decoration panel are coupled to the control panel 3 such that the inner decoration panel and the outer decoration panel can be exposed at the front of the control panel 3.

Specifically, as shown in FIGS. 6 to 8, it is preferable that the decoration panel 140 include an inner decoration panel 142 forming an inner circular band shape when the display unit and the decoration panel are coupled with each other and an outer decoration panel 143 forming an outer circular band shape when the display unit and the decoration panel are coupled with each other.

Practically, the rotary knob 7 is inserted through the inner part of the inner decoration panel, and therefore, the inner decoration panel is disposed between the rotary knob and the display unit 130. The outer decoration panel may be disposed between the display unit and the control panel.

Consequently, the gap between the rotary knob 7 and the display unit 130 and the gap between the display unit 130 and the control panel 3 are uniformly maintained by the inner decoration panel and the outer decoration panel, respectively. Furthermore, these gaps are filled in the band shape, and therefore, it is possible to provide the washing machine with a more pleasing appearance.

The inner decoration panel 142 and the outer decoration panel 143 exposed at the front of the control panel may have gloss different from the display unit and the control panel, and therefore, it is possible to provide the washing machine with a more pleasing appearance.

Of course, it is preferable to integrally form the inner decoration panel and the outer decoration panel, as shown in FIG. 6, so as to accomplish easy manufacture and assembly. However, it is also possible to separately manufacture the inner and outer decoration panels and couple the inner and outer decoration panels to the display unit.

In this case, the inner and outer decoration panels, which are coupled to the inside and the outside of the display unit, respectively, are coupled with each other via the display unit 130.

When the display unit is coupled to the control panel via the decoration panel, it is possible to more easily increase the coupling strength through the decoration panel according to the present invention. The coupling strength obtained according to the present invention is greater than the coupling strength between the conventional display unit and the control panel.

This is because increasing the strength of the decoration panel is easier than increasing the strength of the control panel or increasing the strength of a specific part of the control panel, and, as shown in FIGS. 6 and 7, the display unit 130 is received in a receiving part 145 of the decoration panel 140, whereby both the inner decoration panel 142 and the outer decoration panel 143 increase the coupling strength.

Also, in the case that the display unit includes the inner circumferential display unit and the outer circumferential display unit as previously described, the inner circumferential display unit and the inner decoration panel may be coupled with each other, and the outer circumferential display unit and the outer decoration panel may be coupled with each other.

Preferably, the decoration panel 140 is detachably coupled to the control panel 3. This is so that it is easy to replace the decoration panel 140 and the display unit 130 from the control panel.

This coupling may be accomplished by the engagement of one or more hooks in one or more grooves corresponding to the hooks. Specifically, at least one hook 144 may be formed at the decoration panel 140, at least one groove (not shown) corresponding to the at least one hook 144 may be formed at the control panel, and the at least one hook of the decoration panel may be engaged into the at least one groove, whereby the decoration panel 140 and the control panel 3 are detachably coupled with each other. Of course, one or more grooves may be formed at the decoration panel, and one or more hooks may be formed at the control panel.

With the above-described construction, the display unit is not directly coupled to the control panel but is coupled to the control panel via the decoration panel.

In the washing machine according to the present invention as described above, the decoration panel is disposed between the display unit for displaying the operating conditions of the washing machine inputted by the rotary knob and the lamp supporter, whereby the gap between the display unit and the lamp supporter is decreased.

In the washing machine according to the present invention, on the other hand, it is preferable that the decoration panel include an inner circumferential receiving part 145*a* and an outer circumferential receiving part 145*b* when the display unit includes the inner circumferential display unit and the outer circumferential display unit.

Preferably, the inner circumferential receiving part of the receiving part 145 of the decoration panel is provided with a plurality of holes 146, through which light emitted from the LEDs is transmitted. This is because it is preferable to make the decoration panel 140 of an opaque material that is capable of intercepting the light emitted from the LEDs, although the decoration panel 140 may be made of a transparent material. The respective holes 146 correspond to the respective parts displaying the temperatures of the wash water (see FIG. 5).

Since the remainders of the receiving part 145 excluding the holes 146 are opaque, the light interference with respect to the display unit is minimized even though a specific gap is formed between the decoration panel and the lamp supporter with the result that light emitted from the LEDs leaks through the gap.

Meanwhile, the light emitted from the LEDs may leak through the gap formed between the display unit 130 and the decoration panel 140. In order to minimize the leakage of the light, therefore, it is preferable to couple the display unit 130 and the decoration panel 140 with each other such that the display unit 130 and the decoration panel 140 are brought into tight contact with each other.

However, it is difficult to tightly couple two flat faces without gap between the two flat faces. Consequently, it is preferable that a plurality of ribs 147 be formed between the respective holes 146 of the receiving part 145 in the radial direction.

Also, it is preferable to couple the display unit 130 to the decoration panel 140 in such a manner that the display unit 130 is brought into tight contact with the plurality of ribs 147.

The ribs 147 also serve to interrupt the light interference in the circumferential direction. That is to say, the same principle as the lamp location holes of the previously described lamp supporter is applied to the ribs 147.

Preferably, a step part 148 is formed between the inner circumferential receiving part 145*a* and the outer circumferential receiving part 145*b* of the receiving part 145 of the decoration panel 140.

Of course, this construction is equally applied to the case that the decoration panel includes the inner decoration panel and the outer decoration panel.

When the display unit shown in FIG. 5 is coupled with the decoration panel shown in FIG. 6, the light may leak in the radial direction as well as in the circumferential direction.

Consequently, when the lamp supporter 25 (see FIG. 8) is inserted into the step part 148 shown in FIG. 7, the light interference due to the leakage of the light in the radial direction may be minimized by the step part 148 even though the gap is formed between the inner circumferential receiving part of the decoration panel and the lamp supporter.

Hereinafter, the input and the display of the operating conditions of the washing machine according to the present invention will be described in detail with reference to FIGS. 5 and 8.

Figure 4:
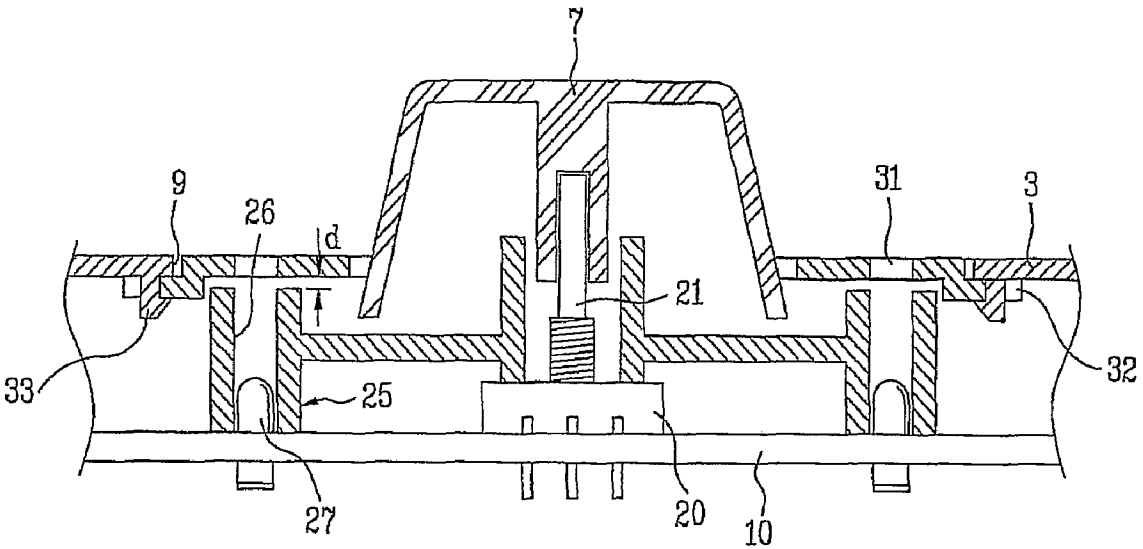
Fig. 4 PRIOR ART
FIG. 4 is a sectional view illustrating a display unit coupling structure of the conventional drum-type washing machine.

The respective temperatures of the wash water shown in FIG. 4 correspond to the respective holes shown in FIG. 6 and the respective lamp location holes 26 of the lamp supporter shown in FIG. 8. Specifically, when a user rotates the rotary knob 7 and then fixes the rotary knob at a specific position, the corresponding lamp is turned on, and light emitted from the turned-on lamp is gathered through the corresponding lamp location hole 26. Subsequently, the gathered light is transmitted through the corresponding hole 146 of the decoration panel 146 and a specific region of the display unit, on which the temperature of the wash water is displayed.

Consequently, the user can read the temperature of the wash water and the washing conditions displayed on the light emitting region of the display unit to confirm the current composite operating conditions of the washing machine.

For example, when the user wishes to select a cotton washing course and set the temperature of the wash water to 60 degrees, he/she rotates the rotary knob and fixes the rotary knob at the corresponding position. As a result, the light emitted from the lamp is transmitted through only the region of the display unit on which the "60 degrees" is displayed.

In this case, the decoration panel serves to reduce the gap between the display unit and the lamp supporter, thereby preventing the leakage of the light.

Especially, the ribs formed at the decoration panel serve to interrupt the leakage of the light according to the same principle as the lamp location holes of the lamp supporter. Also, the step part of the decoration panel interrupts the leakage of the light in the radial direction.

In addition, the decoration panel is disposed at the inside and the outside of the display unit, and therefore, the washing machine is provided with a more pleasing appearance at the front of the control panel. Furthermore, the display unit is securely coupled to the control panel such that the display unit can be also easily detached from the control panel.

Although the present invention has been described with reference to the drum-type washing machine, the present invention may be also applied to a general pulsator-type washing machine, a drying machine, or other home appliances.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The present invention provides a washing machine. More particularly, the present invention provides a washing machine having a structure in which operating conditions of the washing machine are inputted by the rotary knob, and current operating conditions are displayed by the light emitted from the corresponding LED and transmitted through the display unit, wherein the interference of the light emitted from the LED is interrupted, whereby the operating conditions of the washing machine are clearly displayed.

According to the present invention, the decoration panel reduces the gap between the display unit and the lamp supporter, thereby preventing the leakage of the light.

Especially, the ribs formed at the decoration panel serve to interrupt the leakage of the light according to the same principle as the lamp location holes of the lamp supporter. Also, the step part of the decoration panel interrupts the leakage of the light in the radial direction.

In addition, the decoration panel is disposed at the inside and the outside of the display unit, and therefore, the washing machine is provided with a more pleasing appearance at the front of the control panel. Furthermore, the display unit is securely coupled to the control panel such that the display unit can be also easily detached from the control panel.

The invention claimed is:

1. A washing machine comprising:

a control panel mounted at a front part of a machine body of the washing machine;

a rotary knob mounted at the control panel for allowing a user to input operating conditions of the washing machine in a rotating fashion;

a display unit mounted around the rotary knob for displaying the operating conditions of the washing machine inputted by the rotary knob;

a controller coupled to an inside of the control panel, the controller having a plurality of light emitting devices (LEDs) that can be selectively turned on according to the input from the rotary knob;

an LED supporter installed on the controller, the LED supporter to enclose the LEDs; and a decoration panel disposed between the display unit and the LED supporter for allowing light emitted from the selected LED to be transmitted through the display unit without leakage, the decoration panel including:

a receiving part having a first recess, wherein the entire display unit is inserted into the first recess, a plurality of holes provided at the receiving part, wherein the light emitted from the selected LED is transmitted through the hole, and a step part extending in a circumferential direction and forming a second recess at the receiving part, wherein the LED supporter is inserted in the second recess.

2. The washing machine according to claim 1, wherein the display unit is detachably coupled to the decoration panel.

3. The washing machine according to claim 2, wherein the display unit is coupled to the decoration panel by forcible fitting.

4. The washing machine according to claim 3, wherein the display unit is provided with at least one hook or groove, and the decoration panel is provided with at least one groove or hook corresponding to the at least one hook or groove of the display unit, the display unit being coupled to the decoration panel by engagement of the at least one hook into the at least one groove.

5. The washing machine according to claim 1, wherein the decoration panel includes:

an inner decoration panel disposed between the rotary knob and the display unit, and an outer decoration panel disposed between the display unit and the control panel, the inner decoration panel and the outer decoration panel being coupled to the control panel such that the inner decoration panel and the outer decoration panel are exposed at a front of the control panel.

6. The washing machine according to claim 5, wherein the inner decoration panel and the outer decoration panel are integrally formed with each other.

7. The washing machine according to claim 1, wherein the display unit includes:

an inner circumferential display unit disposed to surround the rotary knob, and an outer circumferential display unit disposed to surround the inner circumferential display unit.

8. The washing machine according to claim 7, wherein the receiving part includes:

an inner circumferential receiving part, corresponding to the inner circumferential display unit, disposed to surround the rotary knob, and an outer circumferential receiving part, corresponding to the outer circumferential display unit, disposed to surround the inner circumferential receiving part.

9. The washing machine according to claim 8, wherein the inner circumferential receiving part of the receiving part is provided with the plurality of holes through which the light emitted from the selected LED is transmitted.

10. The washing machine according to claim 8, wherein the step part is formed between the inner circumferential receiving part and the outer circumferential receiving part for interrupting the light interference in the radial direction.

11. The washing machine according to claim 1, wherein the decoration panel is detachably coupled to the control panel.

12. The washing machine according to claim 11, wherein the decoration panel is provided with at least one groove, and the control panel is provided with at least one hook corresponding to the at least one groove of the decoration panel, the decoration panel being coupled to the control panel by engagement of the at least one hook of the control panel into the at least one groove of the decoration panel.

13. The washing machine according to claim 11, wherein the decoration panel is provided with at least one hook, and the control panel is provided with at least one groove corresponding to the at least one hook of the decoration panel, the decoration panel being coupled to the control panel by engagement of the at least one hook of the decoration panel into the at least one groove of the control panel.

14. The washing machine according to claim 1, wherein the decoration panel further includes a plurality of ribs formed between the respective holes of the receiving part in a radial direction for interrupting a light interference in the circumferential direction.

15. The washing machine according to claim 14, wherein the display unit is coupled to the decoration panel in such a manner that the display unit is brought into tight contact with the ribs.

16. A washing machine comprising:

a control panel at a front of the washing machine;

a rotary knob at the control panel to input operating conditions of the washing machine by rotating the rotary knob;

a display unit around a circumference of the rotary knob to display the operating conditions of the washing machine that are inputted by rotating the rotary knob;

a controller coupled to the control panel, the controller having a plurality of light emitting devices (LEDs) to selectively turn on based on the input from the rotary knob;

an LED supporter to individually surround each of the plurality of LEDs; and a decoration panel between the display unit and the LED supporter to allow light emitted from the selected LED to be transmitted through the display unit, the decoration panel including:

a receiving part having a first recess to receive the entire display unit, a plurality of holes provided at the receiving part, wherein the light emitted from the selected LED is transmitted through the hole, and a step part provided in a circumferential arrangement and forming a second recess at the receiving part, wherein the LED supporter is inserted in the second recess.

17. The washing machine according to claim 16, wherein the decoration panel further includes:

an inner decoration panel between the rotary knob and the display unit, and an outer decoration panel between the display unit and the control panel, wherein the inner decoration panel and the outer decoration panel are coupled to the control panel such that the inner decoration panel and the outer decoration panel are exposed at a front of the control panel.

18. The washing machine according to claim 16, wherein the receiving part includes:

an inner circumferential receiving part to surround the circumference of the rotary knob, and an outer circumferential receiving part to surround the inner circumferential display unit.

19. The washing machine according to claim 18, wherein the decoration panel further includes a plurality of ribs formed in a radial direction between the respective holes of the receiving part.

20. The washing machine according to claim 19, wherein the step part is formed between the inner circumferential receiving part and the outer circumferential receiving part for interrupting a light interference in the radial direction.

* * * * *